United States Patent [19]

Gorham, Jr.

[11] Patent Number: 4,462,463

[45] Date of Patent: Jul. 31, 1984

[54] TRIPLE PASS HEAT EXCHANGER

[76] Inventor: Robert S. Gorham, Jr., 205 W. John, Champaign, Ill. 61820

[21] Appl. No.: 370,455

[22] Filed: Apr. 21, 1982

[51] Int. Cl.[3] ..... F28D 7/02

[52] U.S. Cl. ..... 165/140; 165/145; 165/163

[58] Field of Search ..... 165/140, 141, 164, 104.14, 165/163, 145

[56] References Cited

U.S. PATENT DOCUMENTS

| | | | |
|---|---|---|---|
| 854,976 | 5/1907 | Woodcock | 165/140 |
| 1,091,369 | 3/1914 | Mejani | 165/163 |
| 1,799,081 | 3/1931 | Blomquist | 165/164 |
| 1,965,553 | 7/1934 | Lear | 165/140 |
| 2,160,898 | 6/1939 | Peff | 165/140 |
| 2,324,707 | 7/1943 | Johnson | 165/164 |
| 2,418,446 | 4/1947 | Anderson | 165/140 X |
| 2,653,014 | 9/1953 | Sniader | 165/140 |
| 2,941,786 | 6/1960 | Kuljian et al. | 165/140 |
| 4,067,314 | 1/1978 | Bollefer | 165/104.14 X |
| 4,167,965 | 9/1979 | Rogers | 165/140 X |

FOREIGN PATENT DOCUMENTS

| | | | |
|---|---|---|---|
| 250751 | 2/1961 | Australia | 165/141 |
| 8102353 | 12/1981 | Netherlands | 165/140 |

*Primary Examiner*—Sheldon J. Richter

*Attorney, Agent, or Firm*—Woodard, Weikart, Emhardt & Naughton

[57] ABSTRACT

A triple pass heat exchanger for use in a solar energy heating or cooling system includes an assembly of four helically wound lengths of tubing. The helical tubes are arranged relative to each other in a substantially concentric manner so that the first tube is innermost, the second tube outward to the first tube, the third tube outward to the second tube and the fourth tube outward to the third tube. The first and third tubes are coupled in flow communication at a first common inlet and a first common outlet, and the second and fourth tubes are coupled in flow communication at a second common inlet and a second common outlet. A first liquid heat transfer medium flows through the first and third tubes and a second liquid heat transfer medium flows through the second and fourth tubes. A shell encloses the assembly within an inner chamber defined by the shell. The shell has an inlet port and an outlet port so that a third liquid heat transfer medium may be flowed through the inner chamber and across the exterior of the assembly in heat transfer relationship to the second liquid heat transfer medium flowing through the second and fourth helical tubes.

11 Claims, 5 Drawing Figures

TRIPLE PASS HEAT EXCHANGER

BACKGROUND OF THE INVENTION

This invention relates to the field of heat exchangers, and more particularly to heat exchangers which are uniquely suited to be used with solar energy collector systems.

A widely known and currently popular application of solar energy collector systems is to provide primary or auxiliary heating or cooling for residential uses. In such systems, a liquid heat transfer medium is typically circulated through the solar energy collector, both to absorb solar energy for heating purposes during the day, and to release energy at night for nocturnal cooling purposes. In order to provide space heating, the stored heat in the liquid heat transfer medium is circulated through a system of coils and the heat is thereafter transferred by a fan. Providing solar heat for a residential hot water tank is accomplished by circulating cold water from the bottom of a hot water tank through a pipe which is in heat exchange relationship with a pipe from the solar collector. For safety reasons, hot water heating for domestic purposes requires heat exchangers having a double wall construction so that a leak in either one of the domestic hot water pipes or the pipe containing water from the solar collector will not result in a contaminated domestic water supply.

Many homes also have a swimming pool or spa which requires continuous circulation and filtration in a flow path which is separate from the domestic hot water tank. Since spas and swimming pools have much larger volumes than domestic hot water tanks, flow rate requirements differ widely. For these reasons, residential solar energy systems providing heat energy for both potable hot water tanks and spas or swimming pools have previously required separate heat exchangers. One object of the present invention is to provide a single heat exchanger unit having sufficient effectiveness to be adapted for use with solar energy systems and which permits heat exchange with a plurality of sources.

As earlier mentioned, when a potable water supply such as domestic hot water is to be heated by non-potable collector fluid, double walled heat exchangers are often required. As well known in the art, however, the resistance to heat transfer is higher in a double walled heat exchanger as opposed to single walled heat exchanger due to the added material thickness. Thus, the heat exchanger's effectiveness is decreased when the double wall design is employed. This resistance to heat transfer may be minimized by using highly conductive materials such as copper to form the double walls, and also by increasing the area of surface contact between the walls which are in heat exchange relationship. Nevertheless, double walled heat exchangers are usually larger than single walled heat exchangers having similar heat exchange effectiveness, and the double walled construction is considerably more complex.

One design which is typical of counter-flow heat exchangers having double walled construction is disclosed in U.S. Pat. No. 4,067,314 to Bollefer. The heat exchanger disclosed therein employs two helically wound coils superposed in heat exchange relationship within a tank. This device is different from the present invention in several respects. First, the Bollefer device does not disclose the four concentric helixes of the present invention, which offer higher heat exchanger effectiveness for a given sized heat exchanger. Also, the heat exchanger of the present invention employs a third heat transfer medium within a space enclosed by the tank and surrounding the coils. Further, and very importantly, the Bollefer device is not capable of providing energy to a second heating need or demand through a third heat transfer fluid.

It would therefore be an improvement to provide a high efficiency heat exchanger adapted for use with solar energy in a double wall heat exchange relationship with an energy load such as a potable water tank. It would be a further improvement to provide a heat exchanger adapted for use with solar energy systems and which is capable of exchanging heat energy with a plurality of energy loads via separate flow paths.

Other devices which disclose heat exchangers which may have some general relevance to the present invention are as follows:

| U.S. Pat. No. | Inventor |
|---|---|
| 1,425,174 | Cartter et al. |
| 2,149,737 | Jewell |
| 2,339,229 | Wyllie |
| 2,653,014 | Sniader |
| 3,131,553 | Ross |
| 4,172,491 | Rice |
| 4,257,479 | Newton |

U.S. Pat. No. 1,425,174 to Cartter et al. discloses a solar heat collecting apparatus which includes a single walled heat exchanger. The heat exchanger includes a plurality of coils extending vertically to different heights within a heat storage tank. The coils are in flow communication at their lower ends and deliver heated water at different heights to a water tank.

U.S. Pat. No. 2,149,737 to Jewell discloses a heat exchanger of the shell and tube type comprising a shell having a plurality of coils arranged in two sections. Each section comprises a first coil of large size and a second coil of smaller size nested within the first coil.

U.S. Pat. No. 2,339,229 to Wyllie discloses an apparatus for cooling potable liquids on draft including beer and other carbonated beverages and water. A tank containing liquid to be cooled is surrounded by a coil containing a refrigerent which is in turn surrounded in heat conducting contact by a water cooling coil. A discharge conduit connected to the outlet of the tank is in heat conducting contact with at least a portion of the refrigerant coil, but is out of contact with the water cooling coil.

U.S. Pat. No. 2,653,014 to Sniader discloses a liquid cooling and dispensing device wherein a plurality of coils are spirally wound about a reservoir tank in superposed relationship so that leaks in the tank or the coils may be quickly detected.

U.S. Pat. No. 3,131,553 to Ross discloses a refrigeration system including a combination condenser and heat exchanger having a pair of helically wound coils and a casing defining an inner heat exchange chamber and an outer condenser chamber.

U.S. Pat. No. 4,172,491 to Rice discloses a method for operating a heat storage-heat exchange system. Heated fluid is passed through a bed of heat storage medium, creating a hotter portion of the medium. A fluid to be heated is passed through the medium counter-current to the heating fluid to create a cooler portion of the medium. A fluid is also passed from within the system through an intermediate portion of the medium to steepen the temperature gradient between hotter and cooler portions.

U.S. Pat. No. 4,257,479 To Newton discloses a heat exchanger for a solar energy collector wherein the exchanger has an open top inner tank enclosed in a closed outer tank. A coil connected to the hot water tank is disposed within the annular space between the inner and outer tanks. None of the above references, however, discloses a device which accomplishes the object of the present invention.

SUMMARY OF THE INVENTION

One embodiment of this invention includes an assembly with four concentric helixes having a plurality of turns. The helixes are made of metal tubes and the tubes are positioned so that the first tube is innermost, the second tube outward to the first tube, the third tube outward to the second tube, and the fourth tube outward to the third. The first and third tubes are coupled together at a first common juncture of the assembly and coupled together at a second common juncture of the assembly. The second and fourth tubes are coupled together at a third common juncture of the assembly and are coupled together at a fourth common juncture of the assembly. Thus, a first heat transfer medium entering one of the first and second junctures flows through the first and third tubes and exits through the other juncture of the first and second junctures. A second heat transfer medium entering one of the third and fourth junctures flows through the second and fourth tubes and exits through the other of the third and fourth junctures in order to produce heat exchange between the first and second heat transfer mediums. A shell having an inner chamber encloses the four concentric helixes within the inner chamber. The shell is capable of containing a liquid medium within the chamber to facilitate heat transfer between the first and second heat transfer mediums.

Accordingly, it is an object of the present invention to provide an improved device for use with solar energy systems which has a double walled construction for providing heat energy for an energy need or demand. This demand is referred to hereinafter as an energy load and includes such items as a space heating or cooling duct, a potable hot water tank, a swimming pool or spa, a water source heat pump, etc.

It is a further object of the present invention to provide a single heat exchanger device for use with solar energy systems which is capable of exchanging heat energy between the solar collector and a plurality of energy loads by exchanging heat energy in any one of three separate liquid heat transfer mediums with either one of the two remaining liquid heat transfer mediums.

It is a still further object of the present invention to provide a heat exchanger for use with solar energy systems which has all of the advantages previously mentioned, yet which has a relatively simple design and construction.

These and other objects and advantages of the present invention will become more apparent in the following figures and detailed description.

DESCRIPTION OF THE PREFERRED EMBODIMENT

Figure 1:
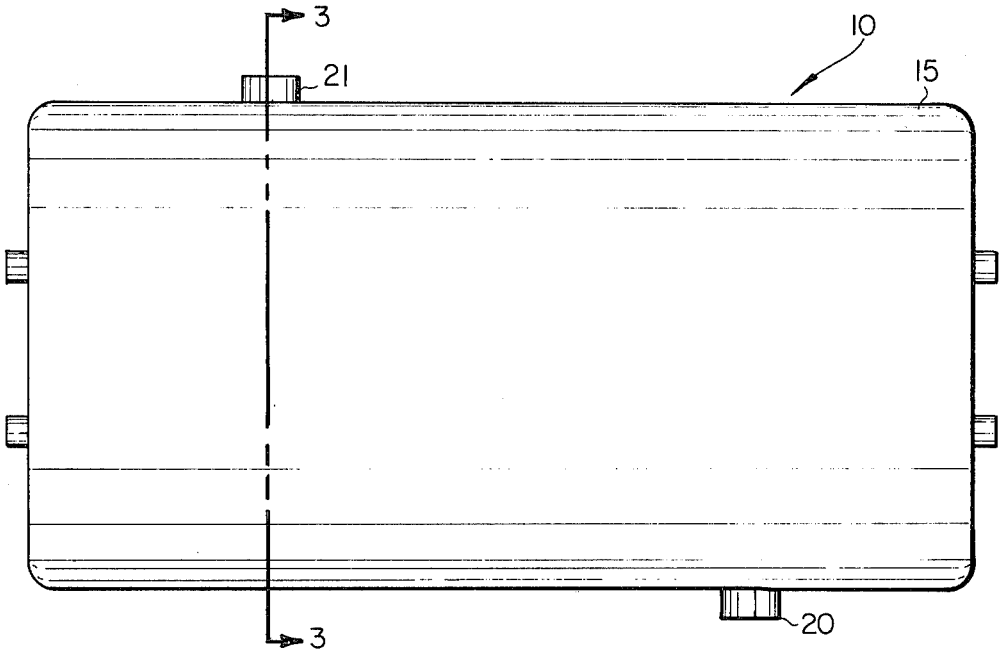
FIG. 1 is an elevation view of the subject invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
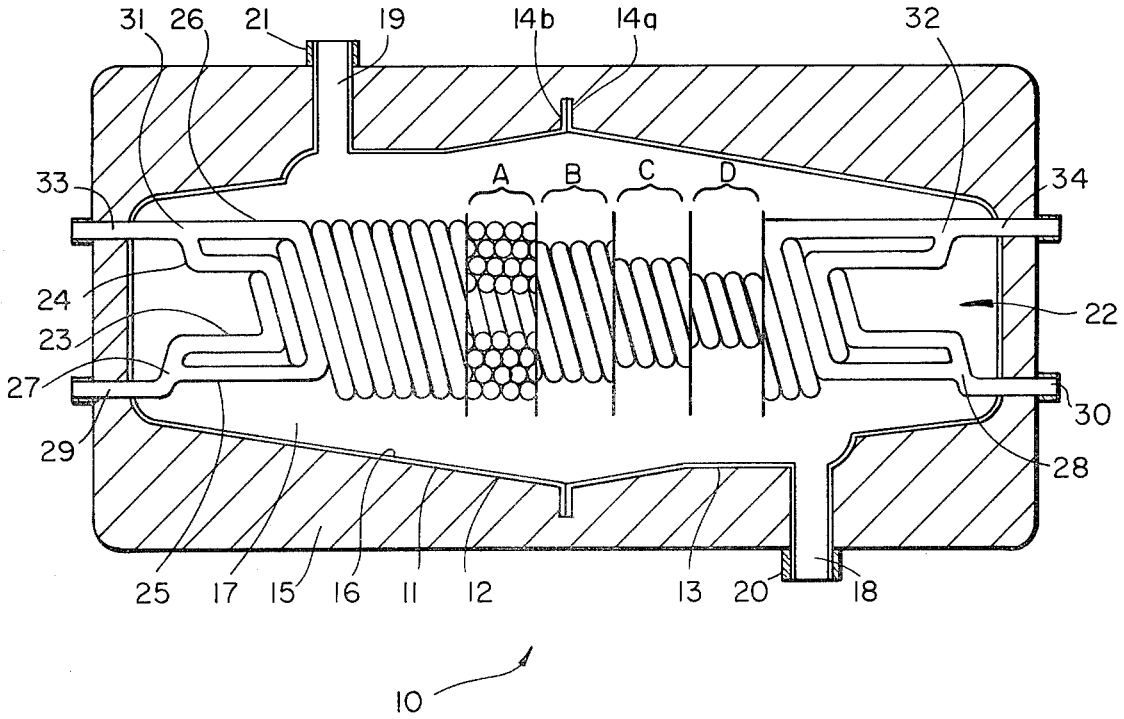
FIG. 2 is a section view of the subject invention showing the interior of the heat exchanger with portions broken away to better illustrate the invention.

Referring to the drawings, FIG. 1 shows heat exchanger 10 in an elevational view. FIG. 2 shows heat exchanger 10 having a hollow shell 11, which is composed of two halves 12 and 13 sealed together along their respective flanges **14*a* and 14*b*. Shell 11 is preferably made of a high temperature fiberglass material. A thickness 15 of insulation surrounds shell 11 except where inlet and outlet tubes are disposed. Thickness 15 is preferably made of a low density polyurethane foam material with an average resistance to heat transfer ("R" value) of 15. The insulation thickness 15 is covered by a hard integral and non-integral finish painted with a non-flammable paint. Inner wall 16 of shell 11 defines a chamber 17 which has a flow passageway through shell inlet 18 and shell outlet 19. The external ends 20 and 21 of inlet 18 and outlet 19 respectively, are made of high temperature $1\frac{1}{2}''$ CPVC threaded fittings and chamber 17 has a 10–12 gallon capacity. Inlet 18 and outlet 19** are thus sufficiently sized to accommodate flow rates encountered in typically sized residential swimming pools.

Received within chamber 17 and mounted to shell 11 is assembly 22 which includes four helically wound lengths of tubing 23–26. Helical tubes 23–26 are concentric about the length of their turns. Helical tube 23 is innermost relative to assembly 22, and helical tubes 23–26 are respectively wound outwards thereto so that helical tube 26 is the outermost wound length of tubing in assembly 22. The respective ends of helical tubes 23 and 25 are joined in flow communication in "Y" fashion to outlet tube portion 29 and inlet tube portion 30 at junctures 27 and 28, respectively. Thus, a heat transfer liquid flowing into outlet tube portion 29 will flow through tubes 23 and 25 and exit through inlet tube portion 30. The respective ends of tubes 24 and 26 are similarly joined in flow communication in "Y" fashion to inlet tube portion 33 and outlet tube portion 34, at junctures 31 and 32, respectively. The outer ends of each tube portion are open and suitably adapted to receive fittings for flow communication. Helically wound tubes 23–26 have a $\frac{5}{8}''$ OD and are made of either refrigeration grade copper having a $\frac{1}{2}''$ ID or 0.035" wall stainless steel. Helical tubes 23–26 are made from equal 25 foot lengths of tubing and are simultaneously wound after being annealed by using a power mandrel. The tube inlet and outlet portions have a $\frac{3}{4}''$ ID and a $\frac{7}{8}''$ OD.

In order to prevent the tubes from collapsing or deforming while they are being wound, the tubes are first filled with water which is then pressurized to 1000–1200 PSI with a conventional hydraulic press (not shown).

Figure 3:
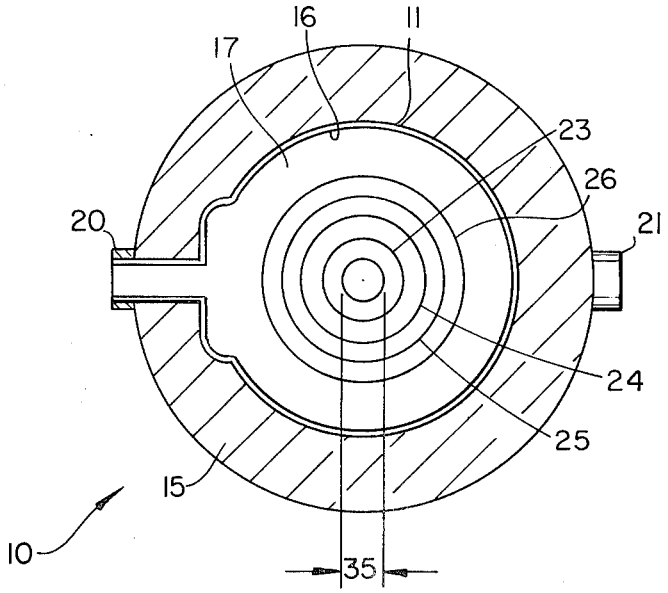
FIG. 3 is a cross-sectional view taken along lines 3—3 of FIG. 1.

The resulting pressure allows the tubes to be tightly wound without deformation. Innermost tube 23 has an open inside diameter 35 (FIG. 3) which is 2⅜ inches.

As clearly shown in Segment A which is a section view along a portion of helical tubes 23–26, tight mechanical contact between helical tubes 23–26 is attained by nesting the turns of successive tubes 24–26 between the turns of the tube next inward thereto. Thus, the turns of each tube are in a staggered relationship as to the turns of an adjacent tube. In Segments B-D, helical tubes 26, 25 and 24 are successively removed to further show the relationship of the turns of adjacent tubes.

Shell inlet 18 and shell outlet 19 are oppositely disposed about assembly 22 so that better turbulence will be created by the flow of a heat transfer liquid around assembly 22. Shell inlet 18 and shell outlet 19 are laterally spaced apart along the length of assembly 22 in order to permit counter-flow heat exchange between a heat transfer fluid flowing through chamber 17 and a second heat transfer fluid flowing through assembly 22. Shell inlet 18 and shell outlet 19 have equal internal diameters which are substantially larger than the internal diameters of helical tubes 23–26. Helical tubes 23–26 are sized to operate efficiently within flow ranges found typically in solar collector arrays, solar domestic hot water systems, space heating systems, and water source heat pump systems. Shell inlet 18 and shell outlet 19 are sized to accommodate larger flow rates generally encountered in swimming pool filtration systems.

Figure 4:
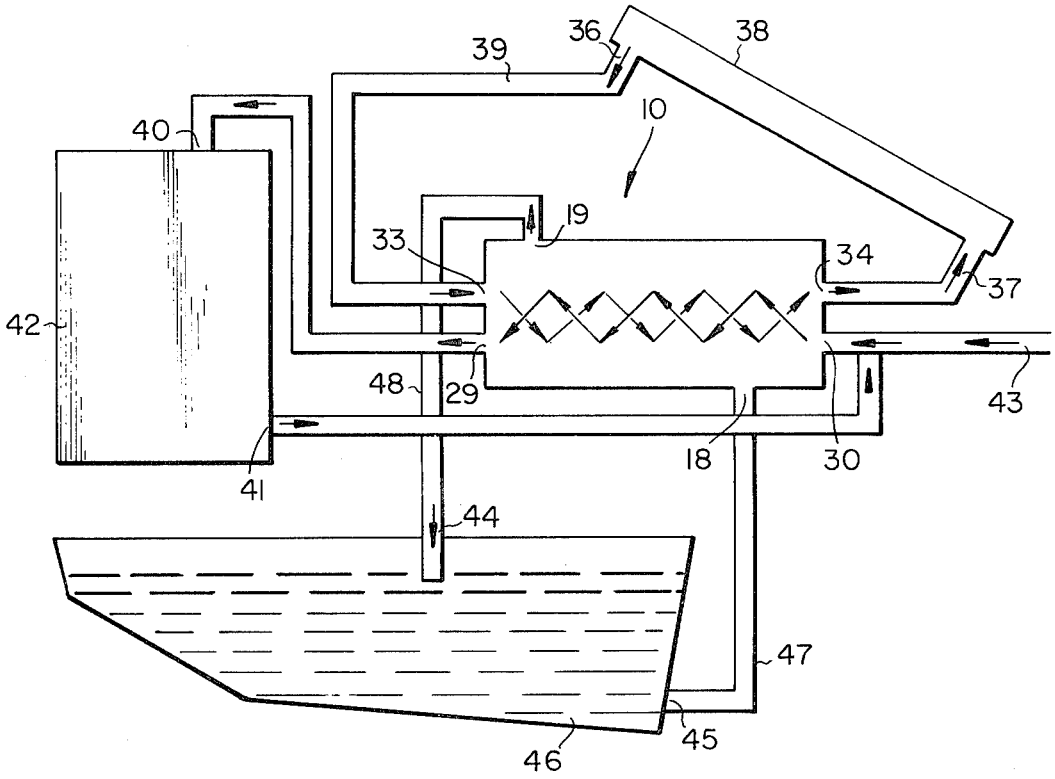
FIGS. 4 and 5 are schematic diagrams illustrating various applications of the subject invention.

Referring now to FIG. 4, triple pass heat exchanger 10 is connected to inlet tube portion 33 and outlet tube portion 34 to the respective outlet 36 and inlet 37 passages of solar collector 38, which may be of a well known flat-plate type construction. A first heat transfer liquid 39 which may be water, is heated by solar energy absorbed in collector 38. The heated liquid leaves collector outlet 36 and enters inlet tube portion 33.

Heat exchanger 10 is connected to circulate a second heat transfer fluid, in this case water, via a separate flow path by connecting outlet tube portion 29 and inlet tube portion 30 to the respective inlet 40 and outlet 41 passages of a conventional domestic hot water tank 42. Cold water in the lower portion of tank 42 is circulated through heat exchanger 10 along with cold water from a cold water supply 43, entering at inlet tube portion 30 and exiting through outlet tube portion 29. Thus, cold water is heated in heat exchanger 10 by the first heat transfer liquid which is flowing counter to the flow of the water from tank 42 and cold water supply 43 circulating through heat exchanger 10.

A third separate flow path is formed through shell inlet 18 and shell outlet 19 and the respective inlet 44 and outlet 45 passages of swimming pool 46. In this flow path, cold water from pool outlet 45 flows through pipe 47 and enters heat exchanger 10 at shell inlet 18. The water is heated in heat exchanger 10 by the heat transfer liquid circulating from the collector. Heated water exits at shell outlet 19 and flows through pipe 48 thereafter entering pool 46 at pool inlet 44.

Referring to FIG. 2, it can be seen that water flowing from shell inlet 18 to shell outlet 19 will flow around outermost helical tube 26 which contains heated liquid from collector 38. Since shell inlet 18 is located near the outlet tube portion 34 and shell outlet 19 is located near inlet tube portion 33, water flowing through chamber 17 will flow substantially counter to the flow of the heat transfer liquid flowing from the collector. Counter flow design produces better heat transfer characteristics than parallel or cross-flow designs in solar energy collector systems. It should be noted that shell inlet 18 and shell outlet 19 can alternatively be connected for space heating through a coil mounted within an air duct. Thus, the third flow path through chamber 17 can provide swimming pool heating in summer months and space heating during colder months, while domestic hot water is supplied through the second flow path through tubes 21 and 23 on a year round basis. It is obvious that as a result of the triple pass or triple loop design, heat exchanger 10 may be connected in a variety of ways according to the specific domestic applications.

Figure 5:
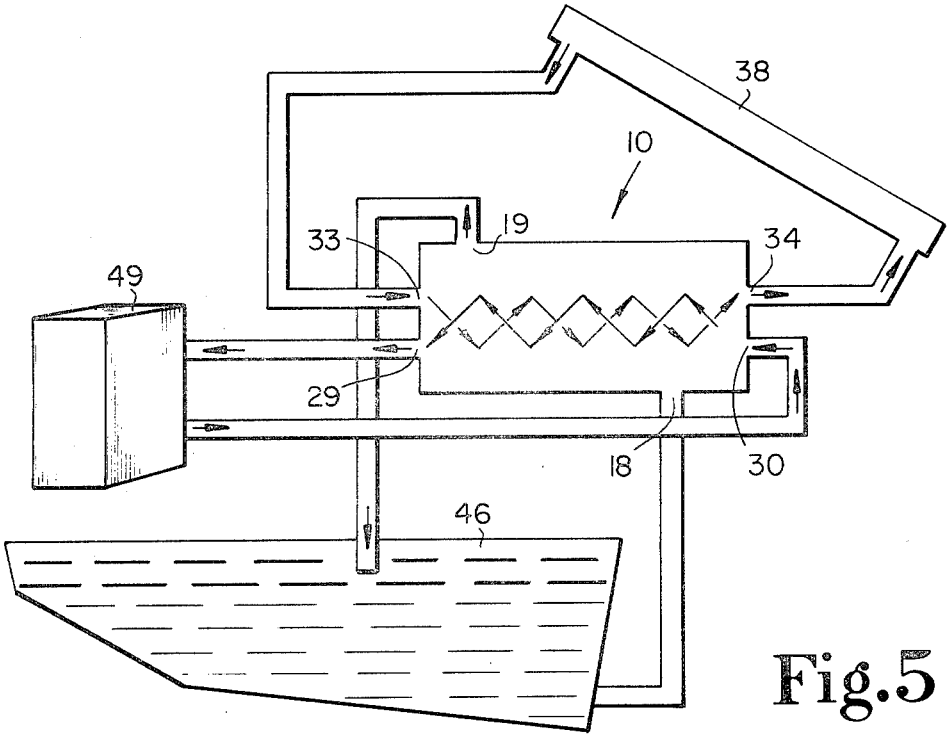

Another option, shown in FIG. 5, is to connect inlet tube portion 30 and outlet tube portion 29 with a conventional type water source heat pump 49. Shell inlet 18 and shell outlet 19 are connected in a manner previously described for heating swimming pool 46. Thus, space heating or cooling is provided through water source heat pump 49 from heat energy provided by collector 38. As well known in the art, flat plate collector 38 is also capable of nocturnal cooling. This is accomplished by reversing the flows through the collector and load loops. Thus, heat energy can be transferred through heat exchanger 10 by exchanging heat energy in any one of the three separate liquid heat transfer mediums flowing through the three separate flow paths with either one of the two remaining liquid heat transfer mediums flowing through the two remaining flow paths. It should be further noted that heat transfer between the first and second flow paths occurs through a double wall construction, which is particularly suited for heating potable water supplies. If the solar collector 38 is to be used only for a domestic hot water supply, the third flow path can be sealed at shell inlet 18 and chamber 17 filled with water in order to facilitate heat transfer between the helical tubes. Shell outlet 19 can be vented to allow for expansion of the heat transfer water and to allow detection of leaks which may occur in assembly 22. Should a leak occur, fluid would enter chamber 17 from assembly 22 forcing water out of the vent at shell outlet 19.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A heat exchanger, comprising:

an assembly of four helically wound lengths of tubing each having a plurality of turns, said lengths of tubing being arranged relative to each other in a substantially concentric manner, so that the first tube is innermost, the second tube outward to said first tube, the third tube outward to said second tube, the fourth tube outward to said third tube, the first and third tubes being coupled together at a first common juncture of said assembly and coupled together at a second common juncture of said assembly, the second and fourth tubes being coupled together at a third common juncture of said assembly and coupled together at a fourth common juncture of said assembly, whereby a first liquid heat transfer medium entering one of said first and second junctures flows through said first and third tubes and exits through the other juncture of said first and second junctures, and a second liquid heat transfer medium entering one of said third and fourth junctures flows through said second and fourth tubes and exits through the other of said third and fourth junctures in order to produce heat exchange between said first and second liquid heat transfer medium for heating or cooling a primary energy load; and a shell having an inner chamber, said shell enclosing said assembly within said inner chamber, said shell having an inlet port and an outlet port for flowing said third liquid heat transfer medium through said inner chamber in a heat transfer relationship with said assembly in order to heat or cool a secondary energy load, adjacent tubes being in a tight mechanical contact with each other, the turns of said second tube being nested in staggered relationship between the turns of said first tube, the turns of said third tube being nested in staggered relationship between the turns of said second tube, and the turns of said fourth tube being nested in staggered relationship between the turns of said third tube.

2. The heat exchanger of claim 1 wherein said tubes are made of one of copper and stainless steel, and said shell is made of high temperature fiberglass.

3. The heat exchanger of claim 1 wherein said shell has an exterior thickness formed of an insulating material so that said shell insulates said inner chamber from temperature differences outside of said shell.

4. The heat exchanger of claim 1 wherein the inlet and outlet ports of said shell are sized to permit substantially greater flow rates for said third liquid heat transfer medium than either the first or second liquid heat transfer mediums.

5. A multiple-pass heat exchanger, comprising:

a generally cylindrical tubing arrangement including four helically wound lengths of tubing which are disposed relative to each other in a substantially concentric orientation, a first length being disposed innermost in said arrangement with a second length disposed directly about said first length, a third length disposed directly about said second length and a fourth length disposed directly about said third length, said first and third lengths being joined in flow communication to a first common inlet and to a first common outlet to accommodate a first working fluid, said second and fourth lengths being joined in flow communication to a second common inlet and to a second common outlet to accommodate a second working fluid, adjacent lengths of said tubing being in a tight mechanical contact with each other, the turns of said second length being nested in staggered relationship between the turns of said first length, the turns of said third length being nested in staggered relationship between the turns of said second length, and the turns of said fourth length being nested in staggered relationship between the turns of said third length; and a surrounding shell enclosing said generally cylindrical tubing arrangement and spaced apart therefrom, said surrounding shell having a flow inlet and a flow outlet for circulation of a third working fluid in a heat exchange relationship across said generally cylindrical tubing arrangement.

6. The multiple-pass heat exchanger of claim 5, wherein said shell includes first and second ends, said first common inlet and said second common outlet located at said first end, and said first common outlet and said second common inlet are located at said second end.

7. The multiple-pass heat exchanger of claim 6, wherein said second and fourth lengths of tubing are for circulating said second working fluid from said second common inlet to said second common outlet, and said first and third lengths of tubing are for circulating said first working fluid from said first common inlet to said first common outlet, whereby said second working fluid flows in a direction which is counter to the flow of said first working fluid.

8. The multiple-pass heat exchanger of claim 7, and further comprising:

a solar energy collector, said collector having an inlet passage and an outlet passage, said collector inlet passage connected in flow communication with said second common outlet and said collector outlet passage connected in flow communication with said second common inlet whereby said second working fluid circulates through said solar energy collector and said second and fourth lengths of tubing.

9. The multiple-pass heat exchanger of claim 8, wherein said shell flow inlet and said shell flow outlet are positioned so that said third working fluid flows in a direction which is substantially counter to the flow of said second working fluid.

10. The multiple-pass heat exchanger of claim 9, wherein said shell includes an outer housing formed of an insulating material so that said shell insulates said working fluids from temperature differences outside said shell.

11. The multiple-pass heat exchanger of claim 10, wherein said lengths of tubing have equal lengths and are made of one of copper and stainless steel, said helically wound lengths of tubing having a plurality of turns, the respective turns of adjacent lengths of tubing nested in staggered relationship with each other.

* * * * *